US008672002B2

(12) United States Patent
Stein

(10) Patent No.: US 8,672,002 B2
(45) **Date of Patent: *Mar. 18, 2014**

(54) KEY LOCATOR

(75) Inventor: Sandra Stein, West Hills, CA (US)

(73) Assignee: The Finding IP Holding Company LLC, West Hills, CA (US)

( * ) Notice: Subject to any disclaimer, the term of this patent is extended or adjusted under 35 U.S.C. 154(b) by 30 days.

This patent is subject to a terminal disclaimer.

(21) Appl. No.: 12/468,012

(22) Filed: May 18, 2009

(65) Prior Publication Data

US 2010/0071171 A1 Mar. 25, 2010

Related U.S. Application Data

(63) Continuation of application No. 11/977,891, filed on Oct. 26, 2007, now Pat. No. 7,537,032, which is a continuation of application No. 10/919,494, filed on Aug. 17, 2004, now Pat. No. 7,308,922.

(51) Int. Cl.
*A45C 11/32* (2006.01)

(52) U.S. Cl.
USPC ..... 150/106; 150/104; 24/3.6; 70/456 R; 190/102

(58) Field of Classification Search
USPC ..... 150/104, 106; 24/3.6, 3.12; 70/456 R, 70/459; 190/102; 63/1.1, 1.2, 12, 43; D3/207, 211, 215; 224/666; 206/37.1
See application file for complete search history.

(56) References Cited

U.S. PATENT DOCUMENTS

| | | | |
|---|---|---|---|
| 110,760 | A | 1/1871 | Harrison |
| 110,873 | A | 1/1871 | Sinclair |
| 159,403 | A | 2/1875 | Foster |
| 195,400 | A | 9/1877 | Richard |
| 210,816 | A | 12/1878 | Stevens |
| 272,772 | A | 2/1883 | Rieger |
| 273,434 | A | 3/1883 | Bagot |
| 279,236 | A | 6/1883 | Fletcher |
| 279,267 | A | 6/1883 | Nock |
| D15,367 | S | 8/1884 | O'Hara |
| 334,101 | A | 1/1886 | Buffum |
| 345,407 | A | 7/1886 | Besse |

(Continued)

FOREIGN PATENT DOCUMENTS

| | | |
|---|---|---|
| CA | 2 531 767 A1 | 6/2007 |
| CA | 2 543 748 A1 | 6/2007 |

(Continued)

OTHER PUBLICATIONS

U.S. Appl. No. 10/919,494, filed Aug. 17, 2004, Stein.

(Continued)

*Primary Examiner* — Sue A Weaver
(74) *Attorney, Agent, or Firm* — Morgan, Lewis & Bockius LLP

(57) ABSTRACT

A key locator includes first and second members. The first member has opposed ends and an intermediate u-shaped region. One of the ends of the first member comprises a hook for engaging the second member which includes a clasp while the other end comprises an enlarged portion for fixing an ornament thereto. The arrangement is suitable for hanging at the open top of a bag-like device such as a purse, backpack or briefcase whereby the ornament is displayed at the same time that the keys are readily accessible without undue fishing efforts.

13 Claims, 5 Drawing Sheets

(56) References Cited

U.S. PATENT DOCUMENTS

| | | | | | |
|---|---|---|---|---|---|
| 376,453 | A | | 1/1888 | Scott | |
| 376,825 | A | | 1/1888 | Kent | |
| 437,550 | A | | 9/1890 | Armentrout | |
| 448,892 | A | | 3/1891 | Staiger | |
| 520,053 | A | | 5/1894 | Hopkins | |
| 528,455 | A | | 10/1894 | Zeller | |
| 533,385 | A | | 1/1895 | Tweedale | |
| 603,247 | A | | 5/1898 | Becker | |
| 603,538 | A | | 5/1898 | Pettibone | |
| 629,213 | A | | 7/1899 | Sheets | |
| 629,224 | A | | 7/1899 | Watkins | |
| 649,217 | A | | 5/1900 | Scherer | |
| 652,996 | A | | 7/1900 | Cotter | |
| 686,124 | A | | 11/1901 | Parker | |
| 703,822 | A | | 7/1902 | Prahar | |
| 722,370 | A | | 3/1903 | Leslie | |
| 753,613 | A | | 3/1904 | McGill | |
| 780,962 | A | | 1/1905 | Perry | |
| 789,352 | A | | 5/1905 | Badger | |
| 843,050 | A | | 2/1907 | Wallerstedt | |
| 867,255 | A | | 10/1907 | Dietz | |
| 882,493 | A | | 3/1908 | Dodge | |
| 889,436 | A | | 6/1908 | Bustanoby | |
| 905,731 | A | | 12/1908 | Merrill | |
| 932,787 | A | | 8/1909 | Kirby | |
| 938,723 | A | | 11/1909 | Swan | |
| 940,642 | A | | 11/1909 | Maass | |
| 946,620 | A | | 1/1910 | Stiggins | |
| 969,767 | A | | 9/1910 | Berg | |
| 995,686 | A | | 6/1911 | Koch | |
| 1,035,946 | A | | 8/1912 | Cardwell | |
| 1,039,900 | A | | 10/1912 | Collis | |
| 1,042,843 | A | | 10/1912 | Toce | |
| 1,053,183 | A | | 2/1913 | Keller | |
| 1,092,031 | A | | 3/1914 | En Earl | |
| 1,106,388 | A | | 8/1914 | Juergens | |
| 1,107,958 | A | | 8/1914 | Jorgensen | |
| 1,109,846 | A | | 9/1914 | Knap | |
| 1,110,760 | A | | 9/1914 | Easton | |
| 1,110,873 | A | | 9/1914 | Boye | |
| 1,155,032 | A | | 9/1915 | Baer | |
| 1,155,296 | A | | 9/1915 | Beuther | |
| 1,158,251 | A | | 10/1915 | McDougall | |
| 1,161,523 | A | | 11/1915 | Phillips | |
| 1,165,882 | A | | 12/1915 | Killion | |
| 1,198,105 | A | | 9/1916 | Butler | |
| 1,199,635 | A | | 9/1916 | Urmston | |
| 1,206,074 | A | | 11/1916 | Zweiner | |
| 1,208,936 | A | | 12/1916 | England | |
| 1,211,025 | A | | 1/1917 | Wright | |
| 1,229,855 | A | | 6/1917 | Alexander | |
| 1,281,656 | A | | 10/1918 | Raschick | |
| 1,283,557 | A | | 11/1918 | Raschick | |
| 1,314,392 | A | | 8/1919 | Glamzo | |
| 1,327,534 | A | | 1/1920 | Eichstedt | |
| 1,343,495 | A | | 6/1920 | Davis | |
| 1,363,567 | A | | 12/1920 | Cobb | |
| 1,364,709 | A | | 1/1921 | Butler | |
| 1,368,156 | A | | 2/1921 | Jackson | |
| 1,379,093 | A | | 5/1921 | Freeberg | |
| 1,388,100 | A | | 8/1921 | Davis | |
| 1,418,979 | A | | 6/1922 | Seferlis | |
| 1,419,408 | A | | 6/1922 | Polhemus | |
| 1,425,089 | A | | 8/1922 | Henry | |
| 1,454,468 | A | | 6/1923 | Crosby | |
| 1,462,205 | A | | 7/1923 | Korns | |
| 1,472,766 | A | | 10/1923 | Fraser | |
| 1,473,361 | A | | 11/1923 | Tebbetts | |
| 1,489,244 | A | | 4/1924 | Gnegy | |
| 1,490,871 | A | | 4/1924 | Wagner | |
| 1,566,206 | A | | 1/1925 | Greene | |
| 1,539,220 | A | * | 5/1925 | Taylor | 24/3.6 |
| 1,524,210 | A | | 7/1925 | Prentice | |
| 1,555,714 | A | | 9/1925 | Kahn | |
| 1,558,213 | A | | 10/1925 | Atkins | |
| 1,571,425 | A | | 2/1926 | Mataloni | |
| 1,578,157 | A | | 3/1926 | Miller | |
| 1,581,016 | A | | 4/1926 | Reiter | |
| 1,583,225 | A | | 5/1926 | Flanders | |
| 1,609,347 | A | | 12/1926 | Dee | |
| 1,618,573 | A | | 2/1927 | Cole | |
| 1,626,987 | A | | 5/1927 | Venegas | |
| 1,629,404 | A | | 5/1927 | Mitchell | |
| 1,648,016 | A | | 11/1927 | Freysinger | |
| 1,651,921 | A | | 12/1927 | Felz | |
| 1,652,972 | A | | 12/1927 | Beck | |
| 1,679,606 | A | | 8/1928 | Graves | |
| 1,683,545 | A | | 9/1928 | Harris | |
| 1,700,132 | A | | 1/1929 | Johnson | |
| 1,715,348 | A | | 6/1929 | Barbara | |
| 1,718,433 | A | | 6/1929 | Rivas | |
| 1,745,836 | A | | 2/1930 | Miller | |
| 1,766,801 | A | | 6/1930 | Ragsdale | |
| 1,817,246 | A | | 8/1931 | Gardine | |
| 1,835,793 | A | | 12/1931 | Lurie | |
| 1,934,889 | A | | 11/1933 | Segal | |
| 1,962,711 | A | | 6/1934 | Duffy | |
| 1,974,499 | A | | 9/1934 | Luce | |
| 2,008,471 | A | | 7/1935 | Schroeder | |
| 2,019,691 | A | | 11/1935 | Morehouse | |
| 2,026,185 | A | | 12/1935 | Lupfer | |
| 2,038,070 | A | | 4/1936 | Welch | |
| 2,051,432 | A | | 8/1936 | Zahn | |
| 2,076,895 | A | | 4/1937 | Johnston | |
| 2,079,401 | A | | 5/1937 | Eisenberg | |
| 2,117,989 | A | | 5/1938 | Ryan | |
| 2,126,826 | A | | 8/1938 | Shively | |
| 2,126,850 | A | | 8/1938 | Whitehead | |
| 2,138,994 | A | | 12/1938 | Bassler | |
| 2,144,755 | A | | 1/1939 | Freedman | |
| 2,159,223 | A | | 5/1939 | Okun | |
| 2,173,008 | A | | 9/1939 | Cheney | |
| 2,201,833 | A | | 5/1940 | Koelling | |
| 2,218,932 | A | | 10/1940 | Collins | |
| 2,219,075 | A | | 10/1940 | Le Veau | |
| 2,224,073 | A | | 12/1940 | Augenstein | |
| 2,224,972 | A | | 12/1940 | Long, Jr. et al. | |
| 2,231,308 | A | | 2/1941 | Walsh | |
| 2,232,503 | A | | 2/1941 | Zarowin | |
| 2,250,328 | A | | 7/1941 | Daniels | |
| 2,271,090 | A | | 1/1942 | Newman | |
| D131,492 | S | | 3/1942 | Lee | |
| 2,286,265 | A | | 6/1942 | Davio | |
| 2,292,563 | A | | 8/1942 | Imhoff | |
| 2,302,341 | A | | 11/1942 | Nash | |
| 2,307,808 | A | | 1/1943 | Segal | |
| 2,320,308 | A | | 5/1943 | Silverman | |
| 2,326,558 | A | | 8/1943 | Pelz | |
| 2,344,694 | A | | 3/1944 | Gardner | |
| 2,389,426 | A | | 11/1945 | Geffner | |
| 2,410,951 | A | | 11/1946 | Kuhnl | |
| 2,411,446 | A | | 11/1946 | Mars | |
| 2,457,195 | A | | 12/1948 | Bagnall | |
| 2,459,735 | A | | 1/1949 | McKinnon | |
| 2,484,547 | A | | 10/1949 | Bishop | |
| 2,487,897 | A | | 11/1949 | Rozsa | |
| 2,498,590 | A | | 2/1950 | Straus | |
| 2,500,198 | A | | 3/1950 | Mullan | |
| 2,500,257 | A | | 3/1950 | Mahan | |
| 2,503,211 | A | | 4/1950 | Ormsbee | |
| 2,532,255 | A | * | 11/1950 | Davis | 248/215 |
| 2,547,524 | A | | 4/1951 | Gross | |
| 2,548,820 | A | | 4/1951 | Reis | |
| 2,564,242 | A | | 8/1951 | Wendt | |
| 2,567,602 | A | | 9/1951 | Higgins | |
| 2,569,629 | A | | 10/1951 | Everitt | |
| 2,571,609 | A | | 10/1951 | Powell | |
| 2,572,703 | A | | 10/1951 | Dennis | |
| 2,589,349 | A | | 3/1952 | Diefenbach | |
| 2,634,470 | A | * | 4/1953 | Grafft, Jr. | 24/3.13 |
| 2,652,586 | A | | 9/1953 | Ramsberger | |
| 2,652,873 | A | | 9/1953 | Barricini | |
| 2,657,568 | A | | 11/1953 | Morrell | |
| 2,659,231 | A | | 11/1953 | Glubiak | |

(56) References Cited

U.S. PATENT DOCUMENTS

| | | | | | |
|---|---|---|---|---|---|
| 2,679,674 | A | | 6/1954 | Hanna | |
| 2,737,698 | A | | 3/1956 | Falk | |
| D178,482 | S | | 8/1956 | Bacon | |
| 2,771,768 | A | | 11/1956 | Tudor | |
| 2,777,180 | A | | 1/1957 | Keating et al. | |
| 2,777,492 | A | | 1/1957 | Kikuchi | |
| 2,783,926 | A | | 3/1957 | Wise | |
| 2,823,537 | A | | 2/1958 | Segal | |
| 2,825,447 | A | | 3/1958 | Kurland | |
| 2,834,389 | A | | 5/1958 | Major | |
| 2,868,254 | A | | 1/1959 | Sand | |
| 2,871,691 | A | | 2/1959 | Bacon | |
| 2,887,747 | A | | 5/1959 | Bellman | |
| 2,931,208 | A | | 4/1960 | Prim | |
| 2,938,375 | A | | 5/1960 | Wehrli | |
| 3,007,568 | A | | 11/1961 | Kurland | |
| 3,008,323 | A | | 11/1961 | Legat | |
| 3,016,224 | A | | 1/1962 | Hall | |
| 3,071,938 | A | | 1/1963 | Davidson | |
| 3,128,812 | A | | 4/1964 | Scheurer | |
| 3,132,504 | A | | 5/1964 | Beilis | |
| 3,146,925 | A | | 9/1964 | Ruderian | |
| 3,147,896 | A | | 9/1964 | Kehl | |
| 3,176,489 | A | | 4/1965 | Sonntag | |
| 3,262,479 | A | | 7/1966 | Leguillon | |
| 3,309,905 | A | | 3/1967 | Shepherd | |
| 3,365,684 | A | | 1/1968 | Stemke | |
| 3,379,041 | A | | 4/1968 | Hanna | |
| 3,421,349 | A | | 1/1969 | St. Clair | |
| 3,469,424 | A | | 9/1969 | Shears | |
| 3,529,649 | A | | 9/1970 | Bennett | |
| 3,564,881 | A | | 2/1971 | Burniski | |
| 3,638,284 | A | | 2/1972 | Baker | |
| 3,657,909 | A | | 4/1972 | Boswell | |
| 3,659,759 | A | | 5/1972 | Walton | |
| 3,670,524 | A | | 6/1972 | Korwin | |
| 3,682,216 | A | | 8/1972 | Nelson | |
| 3,707,742 | A | | 1/1973 | Justice et al. | |
| 3,779,053 | A | | 12/1973 | Langwell | |
| D229,870 | S | * | 1/1974 | Czarny | D3/328 |
| 3,822,446 | A | | 7/1974 | Silverstein | |
| 3,828,595 | A | | 8/1974 | Williams | |
| 3,857,142 | A | | 12/1974 | Hills | |
| 3,866,647 | A | * | 2/1975 | Tarkowski | 150/104 |
| 3,884,059 | A | | 5/1975 | McKee | |
| 3,886,773 | A | | 6/1975 | McGahee | |
| 3,934,317 | A | | 1/1976 | Langwell | |
| 3,970,227 | A | | 7/1976 | Hardy | |
| 4,004,325 | A | | 1/1977 | Hubachek | |
| 4,010,503 | A | | 3/1977 | Denton | |
| 4,079,767 | A | | 3/1978 | Howard | |
| 4,113,156 | A | | 9/1978 | Brito | |
| 4,124,881 | A | | 11/1978 | Haber | |
| 4,166,489 | A | | 9/1979 | Lemelson | |
| D253,676 | S | | 12/1979 | Mathieson | |
| 4,184,304 | A | | 1/1980 | Merchant | |
| 4,194,714 | A | * | 3/1980 | Schultz | 248/308 |
| 4,201,259 | A | | 5/1980 | Alsdorf | |
| 4,210,302 | A | | 7/1980 | Serkez | |
| 4,210,306 | A | | 7/1980 | Schimmel | |
| 4,221,118 | A | | 9/1980 | Chicckine | |
| 4,226,105 | A | | 10/1980 | Wehrman | |
| 4,282,733 | A | | 8/1981 | Schmitt (Johnston) | |
| 4,306,434 | A | | 12/1981 | Drake | |
| D262,498 | S | | 1/1982 | Beilis | |
| 4,319,384 | A | | 3/1982 | Horne | |
| 4,325,273 | A | | 4/1982 | Gibbons | |
| 4,349,975 | A | | 9/1982 | Chubb | |
| 4,359,888 | A | | 11/1982 | Scheineman | |
| 4,384,390 | A | | 5/1983 | Hayakawa | |
| 4,403,366 | A | | 9/1983 | Lucke | |
| 4,407,148 | A | | 10/1983 | Rousseau | |
| 4,430,778 | A | | 2/1984 | Sander | |
| 4,458,511 | A | | 7/1984 | Amelang | |
| 4,516,418 | A | | 5/1985 | Cuttler | |
| 4,523,443 | A | | 6/1985 | Momemers | |
| 4,576,839 | A | | 3/1986 | Parren | |
| 4,587,818 | A | | 5/1986 | Griffin | |
| 4,610,634 | A | | 9/1986 | Kimura | |
| D285,989 | S | | 10/1986 | MacDonald | |
| 4,625,862 | A | | 12/1986 | Clayton | |
| 4,633,691 | A | | 1/1987 | Hardy | |
| D288,984 | S | | 3/1987 | Scheurer et al. | |
| 4,658,455 | A | | 4/1987 | Skillern | |
| 4,665,594 | A | | 5/1987 | Wagner | |
| 4,705,086 | A | | 11/1987 | O'Neill | |
| D296,726 | S | | 7/1988 | Katz | |
| D298,781 | S | | 12/1988 | Thomas | |
| 4,881,150 | A | | 11/1989 | Oyamada | |
| 4,891,961 | A | | 1/1990 | Tsamas | |
| 4,907,694 | A | | 3/1990 | Miller et al. | |
| D307,671 | S | | 5/1990 | Satterly | |
| 4,923,235 | A | | 5/1990 | Stewart | |
| D308,294 | S | | 6/1990 | Krassner | |
| D308,762 | S | | 6/1990 | Barnes et al. | |
| 4,934,521 | A | | 6/1990 | Gebert | |
| D309,830 | S | | 8/1990 | Kraus | |
| 4,955,422 | A | | 9/1990 | Irizarry | |
| D311,451 | S | | 10/1990 | Chan | |
| D312,172 | S | | 11/1990 | Ambrosio | |
| 4,976,124 | A | | 12/1990 | Sanders | |
| 5,031,430 | A | | 7/1991 | Nelson | |
| 5,044,049 | A | | 9/1991 | Owens | |
| 5,048,310 | A | | 9/1991 | Riley | |
| 5,052,081 | A | | 10/1991 | Fuehrer | |
| 5,069,050 | A | | 12/1991 | Chen | |
| 5,077,850 | A | | 1/1992 | Brubaker | |
| 5,078,484 | A | | 1/1992 | Vaughn | |
| 5,098,324 | A | | 3/1992 | Isono | |
| 5,173,999 | A | | 12/1992 | Welk et al. | |
| 5,177,881 | A | | 1/1993 | Moore | |
| 5,183,153 | A | | 2/1993 | Linn | |
| 5,199,560 | A | | 4/1993 | Lee | |
| 5,228,149 | A | | 7/1993 | Phinn | |
| D341,940 | S | | 12/1993 | MacDonald | |
| 5,312,029 | A | | 5/1994 | Tuber | |
| 5,331,721 | A | * | 7/1994 | Raum, Sr. | 24/3.12 |
| D350,279 | S | | 9/1994 | Tate | |
| D352,821 | S | | 11/1994 | Stillwagon | |
| 5,359,870 | A | | 11/1994 | Reutlinger | |
| 5,365,760 | A | | 11/1994 | Song | |
| 5,367,896 | A | | 11/1994 | Sundberg | |
| D353,261 | S | | 12/1994 | Fort et al. | |
| 5,385,282 | A | | 1/1995 | Chen | |
| D357,350 | S | | 4/1995 | Stillwagon | |
| 5,467,808 | A | | 11/1995 | Bell | |
| D366,359 | S | | 1/1996 | Riedl | |
| D371,325 | S | | 7/1996 | Fritsche | |
| 5,535,797 | A | | 7/1996 | Martindale | |
| 5,540,367 | A | | 7/1996 | Kauker | |
| 5,551,269 | A | | 9/1996 | Lewinstein et al. | |
| D377,562 | S | | 1/1997 | Wolfram | |
| D383,304 | S | | 9/1997 | Van Osch | |
| D384,813 | S | * | 10/1997 | King | D3/270 |
| D385,415 | S | | 10/1997 | Turbide | |
| D392,201 | S | | 3/1998 | Chen | |
| D392,797 | S | | 3/1998 | Kampe | |
| 5,722,227 | A | | 3/1998 | Stahlecker | |
| 5,729,870 | A | | 3/1998 | Sharp | |
| 5,752,401 | A | | 5/1998 | MacDonald | |
| 5,768,915 | A | | 6/1998 | Crumrine et al. | |
| 5,768,924 | A | | 6/1998 | Song | |
| 5,778,495 | A | | 7/1998 | Paugh | |
| D396,552 | S | | 8/1998 | Browne | |
| 5,794,768 | A | | 8/1998 | Skeffington | |
| D398,775 | S | | 9/1998 | Fritsche | |
| D402,104 | S | | 12/1998 | Kauker | |
| 5,842,365 | A | | 12/1998 | Bordonaro | |
| D403,500 | S | | 1/1999 | Winter | |
| D403,501 | S | | 1/1999 | Winter | |
| D403,502 | S | | 1/1999 | Winter | |
| 5,864,925 | A | | 2/1999 | McGee | |
| 5,894,642 | A | | 4/1999 | Eberhardt | |
| 5,934,123 | A | | 8/1999 | Eldredge | |

(56) References Cited

U.S. PATENT DOCUMENTS

| | | | | |
|---|---|---|---|---|
| D413,434 | S | 9/1999 | Nielson | |
| D416,675 | S | 11/1999 | MacDonald | |
| 5,983,686 | A | 11/1999 | Lee | |
| 6,017,072 | A | 1/2000 | Grant | |
| 6,026,515 | A | 2/2000 | Nielson | |
| 6,092,405 | A | 7/2000 | Berwick | |
| D437,995 | S | 2/2001 | Perthou | |
| D440,399 | S | 4/2001 | DeRouen et al. | |
| D441,184 | S | 5/2001 | Haapala | |
| 6,243,922 | B1 | 6/2001 | Simon | |
| 6,318,610 | B1 | 11/2001 | Doherty | |
| 6,334,239 | B1 | 1/2002 | Kraut | |
| 6,345,796 | B1 * | 2/2002 | Neuman | 248/308 |
| D455,947 | S | 4/2002 | Goodman | |
| 6,425,405 | B1 | 7/2002 | McRoberts | |
| D462,172 | S * | 9/2002 | Aurelio, Jr. | D3/328 |
| D468,091 | S | 1/2003 | Tipton | |
| 6,536,081 | B2 | 3/2003 | Allen et al. | |
| D474,239 | S | 5/2003 | Rosenbaum | |
| 6,591,646 | B1 | 7/2003 | Huang | |
| D478,207 | S | 8/2003 | Johnson | |
| D478,719 | S | 8/2003 | Mercuri | |
| 6,601,967 | B1 | 8/2003 | Zeller | |
| 6,606,769 | B1 | 8/2003 | Harris | |
| D479,768 | S | 9/2003 | Macevicz | |
| D484,306 | S | 12/2003 | Lau | |
| 6,681,608 | B1 | 1/2004 | Hope | |
| 6,698,061 | B2 | 3/2004 | Ho | |
| 6,772,614 | B1 * | 8/2004 | Cheng | 70/456 R |
| 6,843,086 | B2 | 1/2005 | Fitch | |
| 6,870,483 | B1 | 3/2005 | Davis | |
| D503,850 | S | 4/2005 | Staab | |
| D504,222 | S | 4/2005 | Kieffer | |
| 6,928,943 | B1 | 8/2005 | Neubauer | |
| D510,185 | S | 10/2005 | Chan | |
| 7,003,848 | B2 | 2/2006 | Ho | |
| 7,021,852 | B1 | 4/2006 | Turner, III et al. | |
| 7,093,468 | B2 | 8/2006 | Song | |
| 7,185,996 | B1 | 3/2007 | Caprio | |
| D539,526 | S | 4/2007 | Stein | |
| 7,308,922 | B2 | 12/2007 | Stein | |
| D560,067 | S | 1/2008 | Stein | |
| D569,620 | S | 5/2008 | Stein | |
| D581,655 | S | 12/2008 | Johnson | |
| 7,537,032 | B2 | 5/2009 | Stein | |
| 7,546,753 | B1 | 6/2009 | Kim | |
| D598,646 | S | 8/2009 | Castaline | |
| D602,687 | S | 10/2009 | Castaline | |
| D607,636 | S | 1/2010 | Chiu | |
| 2003/0200687 | A1 | 10/2003 | Wolfe | |
| 2003/0200779 | A1 | 10/2003 | Fitch | |
| 2004/0020813 | A1 | 2/2004 | Moeller et al. | |
| 2004/0195484 | A1 * | 10/2004 | Sheeran | 248/304 |
| 2005/0208848 | A1 | 9/2005 | Grossman | |
| 2005/0257867 | A1 | 11/2005 | Vazin | |
| 2006/0048343 | A1 | 3/2006 | Sinon | |
| 2006/0090302 | A1 | 5/2006 | Colby | |
| 2006/0278311 | A1 | 12/2006 | Mittelstaedt | |
| 2010/0071171 | A1 | 3/2010 | Stein | |

FOREIGN PATENT DOCUMENTS

| | | | |
|---|---|---|---|
| CN | 2357549 | Y | 1/2000 |
| CN | 2571212 | Y | 9/2003 |
| CN | 2706037 | Y | 6/2005 |
| CN | 2877013 | Y | 3/2007 |
| CN | 200990920 | Y | 12/2007 |
| CN | 201015872 | Y | 2/2008 |
| CN | 201355822 | Y | 12/2009 |
| DE | 20 2004 015 919 | U1 | 3/2005 |
| DE | 10 2008 032 303 | A1 | 1/2010 |
| EP | 0 723 831 | A1 | 7/1996 |
| EP | 1 486 280 | A1 | 12/2004 |
| EP | 1 731 990 | A2 | 12/2006 |
| FR | 2606258 | A1 | 5/1988 |
| FR | 2 931 405 | A1 | 11/2009 |
| GB | 309395 | | 1/1928 |
| GB | 2180137 | A | 3/1987 |
| GB | 2274236 | A | 7/1994 |
| GB | 227 5173 | A | 8/1994 |
| GB | 2 452 098 | A | 2/2009 |
| GB | 2 457 169 | A | 8/2009 |
| GR | 1006621 | | 12/2009 |
| JP | 2003 174913 | A | 6/2007 |
| KR | 20-0434896 | Y1 | 12/2006 |
| KR | 10-0741718 | B1 | 3/2007 |
| KR | 20-2008-0001797 | | 6/2008 |
| KR | 20-2008-0004605 | | 10/2008 |
| NL | 1032954 | | 8/2008 |
| WO | WO 2010/004399 | A1 | 1/2010 |

OTHER PUBLICATIONS

U.S. Appl. No. 29/260,084, filed May 17, 2006, Stein, Sandra.
U.S. Appl. No. 11/977,891, filed Oct. 26, 2007, Stein, Sandra.
Mississippi Quarter from the United States Mint, issued 2002.
Office Action, dated Oct. 23, 2006, for U.S. Appl. No. 10/919,494.
Office Action, dated Sep. 10, 2007, for U.S. Appl. No. 10/919,494.
Office Action, dated Feb. 21, 2007, for U.S. Appl. No. 10/919,494.
Attorneys for Defendant Charm Zone, Inc., "Charm Zone, Inc.'s Motion to Amend Answer; Opposition to Plaintiff's Motion for Judgment on the Pleadings Re: Affirmative Defense of Inequitable Conduct; and Opposition to Motion to Quash Deposition," Document 46 dated Apr. 23, 2010, in United States District Court Northern District of California Case No. CV 09-3623 CRB.
Attorney for Defendant Charm Zone, Inc., "Declaration of Robert P. Andris in Support of Charm Zone, Inc.'s Motion to Amend Answer; Opposition to Plaintiff's Motion for Judgment on the Pleadings Re: Affirmative Defense of Inequitable Conduct; Opposition to Motion to Quash Deposition," Document 46-1 dated Apr. 23, 2010, in United States District Court Northern District of California Case No. CV 09-3623 CRB.
Attorneys for Defendant Charm Zone, Inc., "Exhibit A, Charm Zone, Inc.'s Amendment to Answer to Complaint F.R.C.P. Rule 15(a)," Document 46-2 dated Apr. 23, 2010, in United States District Court Northern District of California Case No. CV 09-3623 CRB.
Counsel for Plaintiff Alexx, Inc., "Reply in Support of Motion for Judgment on the Pleadings; Motion to Quash," Document 47 dated Apr. 26, 2010, in United States District Court Northern District of California Case No. CV 09-3623 CRB.
Attorney for Plaintiff Alexx, Inc., "Notice of Withdrawal of Motion for Judgment on the Pleadings; Motion to Quash," Document 50 dated Apr. 29, 2010, in United States District Court Northern District of California Case No. CV 09-3623 CRB.
Attorneys for Plaintiff Alexx, Inc., "Amended Stipulation and Order Re: Dismissal with Prejudice of Defendant Charm Zone, Inc.," Document 88 dated Jul. 23, 2010, in United States District Court Northern District of California Case No. CV 09-3623 CRB.

* cited by examiner

KEY LOCATOR

CROSS REFERENCE TO RELATED APPLICATIONS

This application is a continuation application of U.S. patent application Ser. No. 11/977,891, filed on Oct. 26, 2007, now patented as U.S. Pat. No. 7,537,032, the entire contents of which is hereby incorporated by reference herein. U.S. patent application Ser. No. 11/977,891 is a continuation application of Ser. No. 10/919,494, filed on Aug. 17, 2004, now patented as U.S. Pat. No. 7,308,922.

BACKGROUND

1. Field of the Invention

The present invention relates to key holders. More particularly, this invention pertains to a key holder that is especially adapted to facilitate the ready location of keys in a purse, backpack, briefcase or like bag.

2. Brief Description of the Prior Art

A common and popular type of purse or like bag has a top that includes at least a region that is upwardly open in use. Often this type of bag is rather deep, permitting the owner-user to store a variety of items. Further, such depth is generally considered' fashionable. A known drawback of the above-described purse or like bag configuration resides in the difficulty of readily retrieving keys, or a group thereof gathered on a key chain, from'its interior. This can lead to the frustration of the owner-user and to others. For example, the difficulty of locating car keys at the bottom of a purse can cause significant delay in vacating a parking space.

SUMMARY OF THE INVENTION

The present invention addresses the preceding and other shortcomings of the prior art by providing a key locator. Such key locator includes a first member having opposed and portions.

The member incorporates a u-shaped region intermediate the end portions. A second member includes a clasp for selectively retaining at least one key. The first and second members are engaged to one another.

The preceding and other features of the invention will become further apparent from the detailed description that follows. Such description is accompanied by a set of drawing figures. Numerals of the drawing figures correspond to numerals of the written description with like numerals referring to like features throughout both the written description and the drawing figures.

DETAILED DESCRIPTION OF THE PREFERRED EMBODIMENT

Figure 1A:
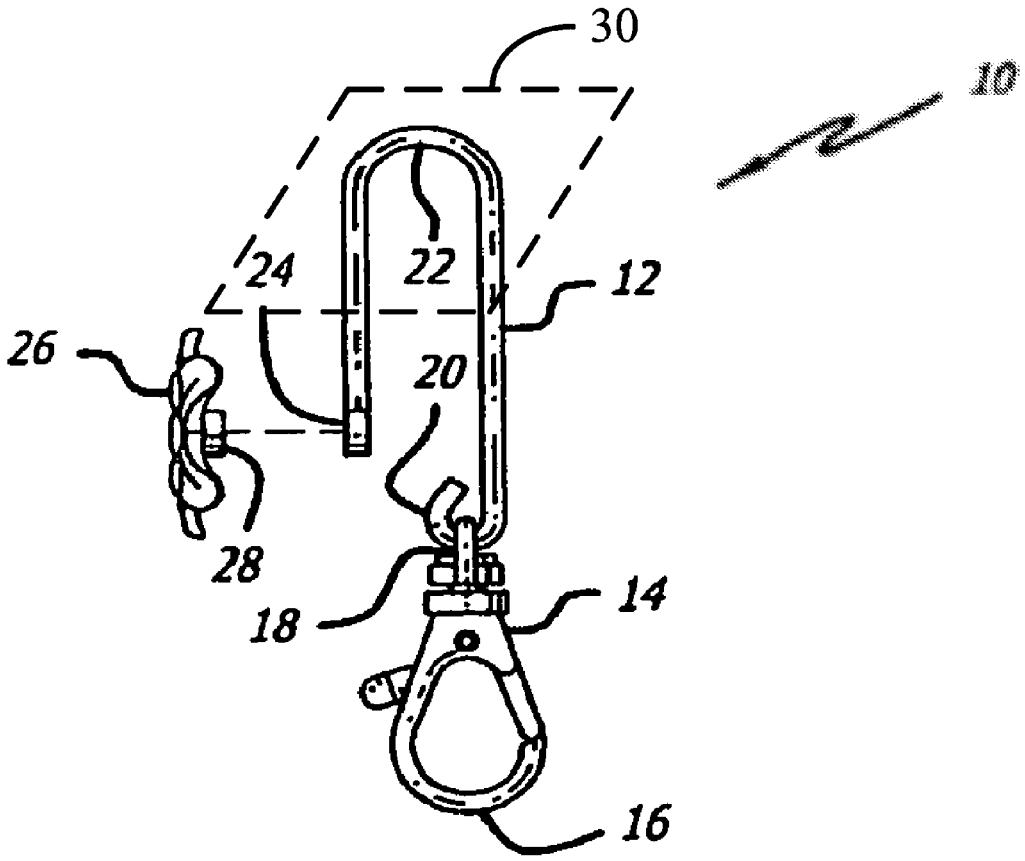
FIGS. 1(*a*) and 1(*b*) are a front elevation view of the key locator of the invention and a partial planar view of the ornament mounting pad thereof respectively, and FIG. 1(*c*) is a front elevation view of the key locator of the invention with the decorative element shown attached and in which FIGS. 1(*a*) and 1(*c*) disclose a plane 30 defining a planar bent center region.
Figure 1B:
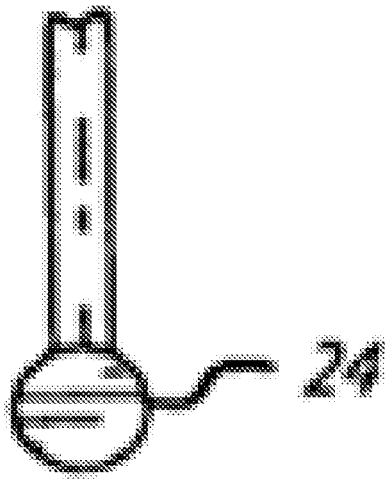
Figure 1C:
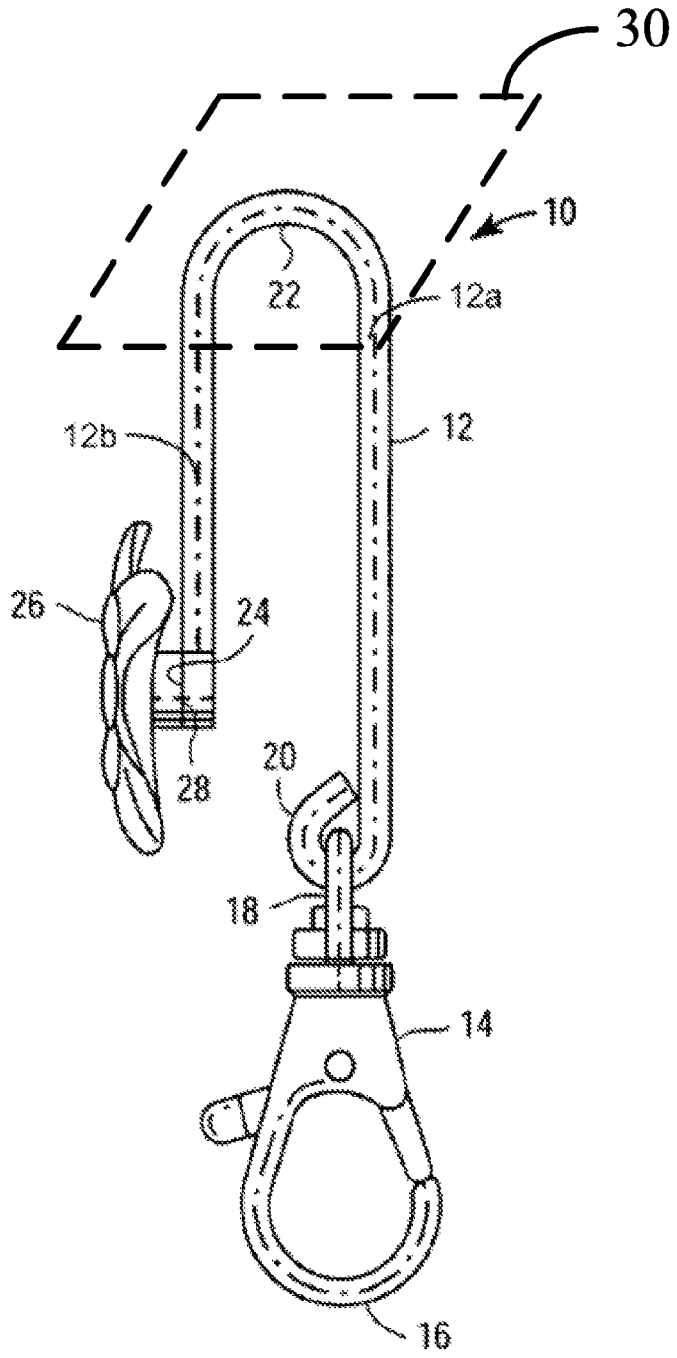

Turning now to the drawings, FIG. 1(*a*) is a front elevation view of the key locator 10 of the invention. The key locator 10 comprises interlocking first and second members 12 and 14 respectively. Each of the first and second members 12, 14 is preferably of steel or other metal although plastic or other rigid elastomeric material may be employed.

The second member 14 includes a clasp 16 that is preferably rotatably engaged to an inverted u-shaped element 18. The u-shaped element 18 is arranged to engage a hook 20 at one end of the first member 12 to provide flexible engagement of the members 12 and 14.

The first member 12 includes a u-shaped interior region 22. Its opposed end, as shown clearly in FIG. 1(*b*), comprises an enlarged region 24 that serves as an ornament mounting pad for affixation of a decorative ornament 26. The ornament 26, comprising a flower-like shape as shown in the drawings but not. limited thereto, is arranged to face away from the interior of the first member 12 with its back portion 28 preferably fixed to the enlarged region 24 of the member by solder or the like.

Figure 2:
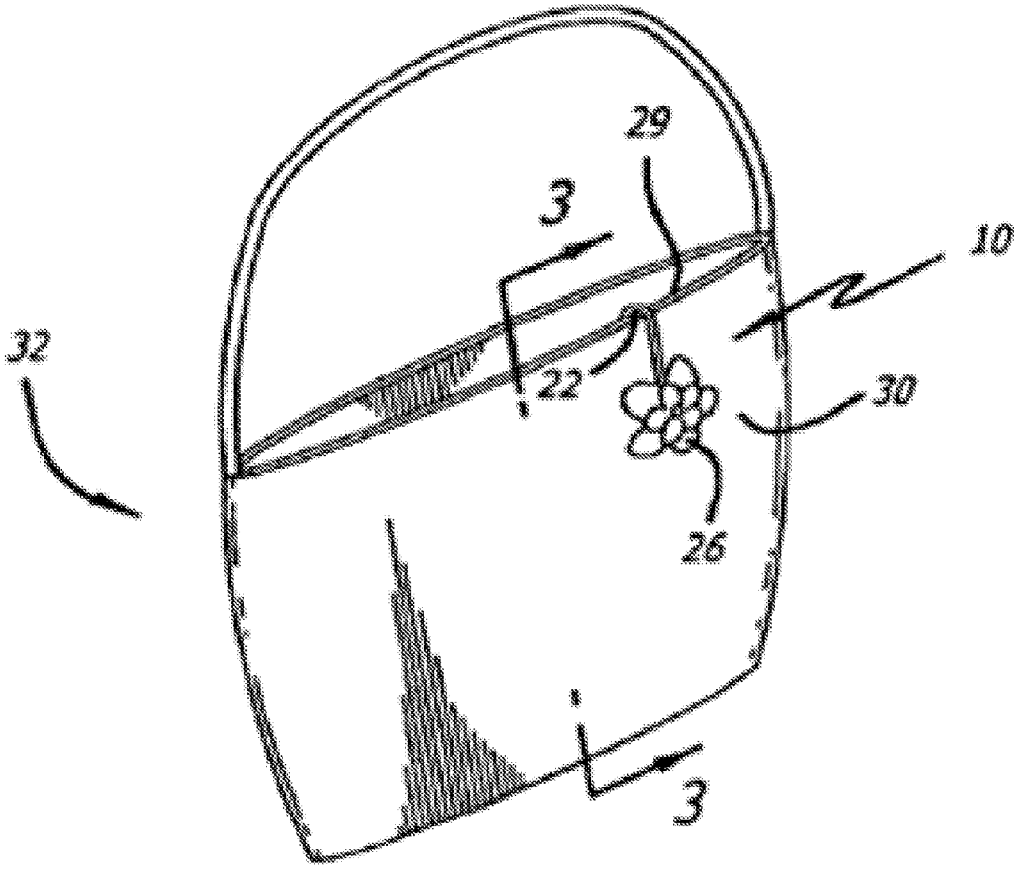
FIG. 2 is a perspective view of the key locator of the invention in use.

FIG. 2 is a perspective view of the key locator 10 of the invention in use. In FIG. 2, the key locator 10 is hung from the upper edge 29 of a side panel 30 of a bag-like purse 32 with the u-shaped region 22 overhanging the side panel 30 so that the face of the ornament 26 is exposed. This provides the user with an attractive adjunct to the purse 32 that serves the additional function of readily locating the key locator 10.

Figure 3:
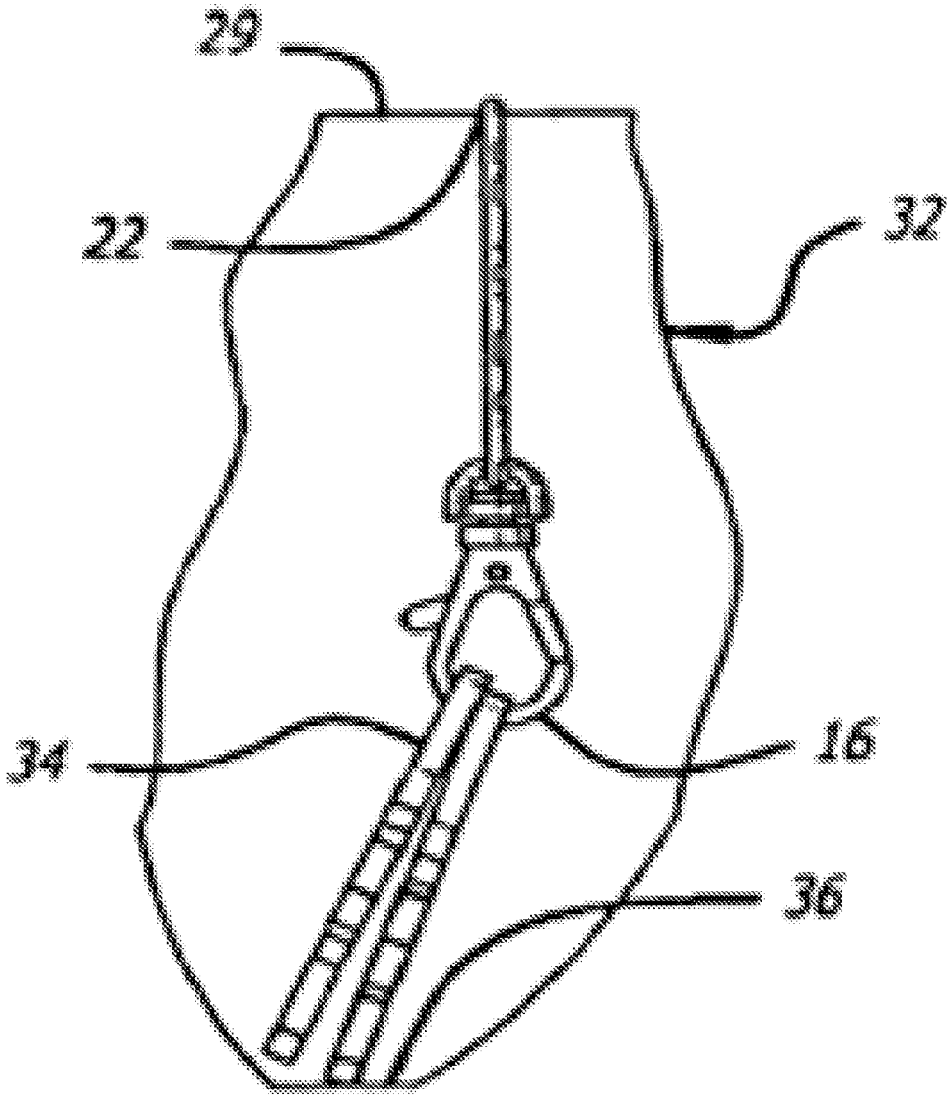
FIG. 3 is a cross-sectional view of the key locator of the invention in use taken at line 3-3 of FIG. 2.

FIG. 3 is a cross-sectional view of the key locator of the invention in use taken at line 3-3 of FIG. 2. Keys 34, secured by the clasp 16 of the second member 14, are seen to lie near or at the bottom 36 of the bag-like purse 32, somewhat suspended from the upper edge 29 of the side panel 30. The u-shaped interior region 22 of the first member 12 of the key locator 10, as mentioned with reference to the preceding figure, is draped or hung over the upper edge 29 to create the suspension effect. The altitude of the bottom of the key locator 10 and keys 34 will depend upon the length of the key locator 10 relative to the depth of the side panel 30 of the bag-like purse 32. However, regardless of the precise altitude of the keys 34 within the purse 32, they may be readily located due to the visible presence of the ornament 26.

Thus, it can be seen that the present invention provides a key locator especially suitable for use with a purse, backpack, briefcase or other bag-like device. By employing the key locator of the invention in conjunction with such a device, one may find keys stored within without delay. Further, by providing a decorative ornament for indicating the location of the key locator, the appearance of the bag is enhanced.

While this invention has been described with reference to its. presently preferred embodiment, it is not limited thereto. Rather the invention is limited only insofar as it is defined by the following set of patent claims and includes within its scope all equivalents thereof.

What is claimed is:

1. A key locator comprising, in combination:

a) a bent rod-shaped first member having a bent first end portion and a second end portion; and b) a second member configured for selectively retaining at least one key; wherein said bent first end portion and said second end portion are opposed to each other;

said bent rod-shaped first member incorporates a planar bent center region intermediate said bent first end portion and said second end portion thereby forming an interior of the key locator;

said bent first end portion and said second end portion are not urged against each other and are configured to allow said bent center region to hang from an edge;

said bent first end portion of said bent rod-shaped first member substantially permanently and flexibly interlocks with the second member; and said second end portion of said bent rod-shaped first member comprises an ornament mounting pad that is configured for affixation of an ornament so that the ornament faces away from the interior of the key locator.

2. The key locator of claim 1, wherein said bent rod-shaped first member and said second member are each made of a material selected from the group consisting of metal, steel, and plastic.

3. The key locator of claim 2, wherein said bent rod-shaped first member and said second member are each made of metal.

4. The key locator of claim 2, wherein said bent rod-shaped first member and said second member are each made of plastic.

5. The key locator of claim 1, wherein the edge is an upper edge of a side panel of a bag-like purse.

6. The key locator of claim 5, wherein the bag-like purse is a purse, a backpack, or a briefcase.

7. The key locator of claim 1, wherein said bent rod-shaped first member and said second member are configured so that when the bent rod-shaped first member is retrieved from the edge, the second member is necessarily retrieved.

8. The key locator of claim 1, wherein the key locator further comprises said ornament.

9. The key locator of claim 1, wherein the planar bent center region is u-shaped.

10. A key locator comprising, in combination:

a) a bent rod-shaped first member having a first end portion and a second end portion; and b) a second member comprising a closed form clasp that is configured for selectively retaining at least one key; wherein said first end portion and said second end portion are opposed to each other;

said bent rod-shaped first member incorporates a planar bent center region intermediate said first end portion and said second end portion thereby forming an interior of the key locator;

said first end portion and said second end portion are not urged against each other and are configured to allow said planar bent center region to hang from an edge;

said first end portion of said bent rod-shaped first member is configured for substantially permanently and flexibly engaging with the second member; and said second end portion of said bent rod-shaped first member comprises an ornament mounting pad that is configured for affixation of an ornament so that the ornament faces away from the interior of the key locator.

11. The key locator of claim 10, wherein said closed form clasp is rotatably fixed to a bent-shaped element of said second member, wherein the bent-shaped element of said second member substantially permanently and flexibly interlocks with said first end portion of said bent rod-shaped first member.

12. The key locator of claim 10, wherein the key locator further comprises said ornament.

13. A method comprising:

a) retaining at least one key by a second member of an apparatus that comprises at least said second member and a bent rod-shaped first member, wherein the second member is configured for selectively retaining at least one key, wherein (i) said bent rod-shaped first member of said apparatus has a bent first end portion and a second end portion, wherein said bent first end portion and said second end portion are opposed to each other, (ii) said bent rod-shaped first member incorporates a planar bent center region intermediate said bent first end portion and said second end portion thereby forming an interior of the apparatus, wherein said bent first end portion and said second end portion are not urged against each other and are configured to allow said bent center region to hang from an upper edge of a side panel of a bag-like purse, (iii) said bent first end portion of said bent rod-shaped first member substantially permanently and flexibly interlocks with said second member, and (iv) said second end portion of said bent rod-shaped first member comprises an ornament mounting pad that is configured for affixation of an ornament so that the ornament faces away from the interior of the key locator;

b) hanging the apparatus from said upper edge of said side panel of said bag-like purse with the bent center region overhanging the side panel so that said second end portion is exposed; and c) retrieving said bent rod-shaped first member of said apparatus from said upper edge such that, when said bent rod-shaped first member is retrieved from the upper edge, the at least one key retained by the second member is necessarily retrieved.

* * * * *